US011172769B2

(12) United States Patent
Schotsman

(10) Patent No.: US 11,172,769 B2
(45) Date of Patent: Nov. 16, 2021

(54) REFRIGERATION BIN

(71) Applicant: Cayuga Displays Inc., Cayuga (CA)

(72) Inventor: Tom Schotsman, Cayuga (CA)

(73) Assignee: Cayuga Displays Inc., Cayuga (CA)

( * ) Notice: Subject to any disclaimer, the term of this patent is extended or adjusted under 35 U.S.C. 154(b) by 141 days.

(21) Appl. No.: 16/372,906

(22) Filed: Apr. 2, 2019

(65) Prior Publication Data

US 2020/0071053 A1 Mar. 5, 2020

Related U.S. Application Data

(60) Provisional application No. 62/726,618, filed on Sep. 4, 2018.

(51) Int. Cl.

| | |
|---|---|
| ***A47F 3/04*** | (2006.01) |
| ***B65D 81/18*** | (2006.01) |
| ***F25D 17/06*** | (2006.01) |
| *F25B 47/02* | (2006.01) |

(52) U.S. Cl.

CPC ..... *A47F 3/0443* (2013.01); *B65D 81/18* (2013.01); *F25D 17/067* (2013.01); *A47F 2003/0473* (2013.01); *F25B 47/022* (2013.01); *F25D 2300/00* (2013.01); *F25D 2303/0832* (2013.01); *F25D 2303/0845* (2013.01); *F25D 2331/804* (2013.01); *F25D 2331/809* (2013.01)

(58) Field of Classification Search

CPC .... A47F 3/0443; A47F 3/0447; A47F 3/0456; A47F 2003/0473; F25D 17/067

See application file for complete search history.

(56) References Cited

U.S. PATENT DOCUMENTS

| | | | | | |
|---|---|---|---|---|---|
| 4,161,868 | A * | 7/1979 | Kennedy | A47F 3/0486 | 62/252 |
| 4,439,993 | A | 4/1984 | Wallace | | |
| 4,840,040 | A | 6/1989 | Fung | | |
| 4,882,910 | A * | 11/1989 | Meehan | A47F 3/0443 | 62/256 |
| 5,007,249 | A | 4/1991 | Van Druff, Jr. | | |
| 5,442,932 | A * | 8/1995 | O'Hearne | A47F 3/0447 | 62/255 |
| 5,477,702 | A * | 12/1995 | Kennedy | A47F 3/0447 | 62/256 |

(Continued)

FOREIGN PATENT DOCUMENTS

| | | |
|---|---|---|
| DE | 19542978 | 5/1997 |

*Primary Examiner* — Christopher R Zerphey
(74) *Attorney, Agent, or Firm* — Lipsitz & McAllister, LLC

(57) ABSTRACT

A refrigeration bin is disclosed. The bin includes a product display area defined by four side walls, a floor, and an access opening. Also included are an air supply vent on each of a first opposing set of the side walls, and an air return vent near each of a second opposing set of the side walls, in which the second opposing set of the side walls are adjacent to the first opposing set of the side walls. There is a return air duct, a first end of the return air duct in air flow communication with the air return vent, and a supply air duct, the first end of the supply air duct in air flow communication with the air supply vent, allows air flow in the display area. A cooling device is included for cooling air before it enters the supply air duct. The refrigeration bin can be useful to showcase foodstuffs in grocery stores and the like.

8 Claims, 12 Drawing Sheets

(56) References Cited

U.S. PATENT DOCUMENTS

| | | | | |
|---|---|---|---|---|
| 9,861,213 | B2 * | 1/2018 | Goch | A47F 3/0452 |
| 2009/0249811 | A1 * | 10/2009 | Shin | A47F 3/0443 62/251 |
| 2013/0167579 | A1 * | 7/2013 | Delgadillo | F25D 13/00 62/426 |

* cited by examiner

| | | Near Right Top | Near Right Bottom | Near Left Top | Near Left Bottom | Center Top | Center Bottom | Far Right Top | Far Right Bottom | Far Left Top | Far Left Bottom | Ta(drybulb) | Ta(wetbulb) | Tb | Lux | Airflow | Radiant Heat |
|---|---|---|---|---|---|---|---|---|---|---|---|---|---|---|---|---|---|
| | | °C | °C | °C | °C | °C | °C | °C | °C | °C | °C | °C | °C | °C | lx | m/s] | °C |
| Max | | 1.4 | -3.0 | 2.7 | -2.2 | 1.4 | -1.8 | 2.7 | -2.6 | 2.0 | -3.4 | 26.5 | 19.7 | 26.2 | 2553.0 | 0.10 | 22.5 |
| Min | | 0.3 | -3.9 | 1.1 | -3.4 | 0.5 | -2.6 | 1.5 | -3.6 | 0.8 | -4.2 | 23.6 | 17.3 | 23.7 | 2505.0 | 0.02 | 22.5 |
| Avg | | 0.8 | -3.5 | 1.8 | -2.9 | 0.9 | -2.3 | 2.0 | -3.1 | 1.3 | -3.9 | 24.6 | 18.1 | 24.4 | 2538.6 | 0.05 | 22.5 |

FIG.12

REFRIGERATION BIN

This application claims the benefit of U.S. provisional patent application No. 62/726,618 filed on Sep. 4, 2018, which is incorporated herein by reference in its entirety and for all purposes.

FIELD OF THE INVENTION

The present invention relates to the field of refrigeration bins of the type used in grocery stores for showcasing goods that require refrigeration.

BACKGROUND OF THE INVENTION

It is well known to use refrigerated bins to showcase foodstuffs in grocery stores and the like. A typical bin has an open top and a chamber. Goods are stored in the chamber. To ensure that the goods remain surrounded with relatively cold air, the goods are stored well below the open top (through which the goods are viewed) which is deleterious from the standpoint of visibility.

SUMMARY OF THE INVENTION

According to one aspect of the invention, there is provided a refrigeration bin. The refrigeration bin includes a product receiving area defined by four side walls, a floor, and an access opening. There is an air supply vent on each of a first opposing set of the side walls, and an air return vent near each of a second opposing set of the side walls and flanking a product display area. There is a return air duct, a first end of which is in air flow communication with the air return vent, and a supply air duct, the first end of which is in air flow communication with the air supply vent. Also included is a cooling device for receiving air, cooling air so received and providing said cooled air to the supply duct.

According to another aspect, there can be provided a cooling area located below the floor of the product receiving area, the cooling area being defined by lower side walls and a lower floor.

According to another aspect, the cooling device can be in the cooling area.

According to another aspect, a second end of the return air duct can be in air flow communication with the cooling area.

According to another aspect, a second end of the supply air duct can be in air flow communication with the cooling area, and the cooling device can be at the interface between the cooling area and the second end of the supply air duct.

According to another aspect, each of the first opposing set of side walls can have a hollow interior which defines at least in part the supply air duct.

According to another aspect, there can be provided air circulation means in the cooling area, positioned to direct air to the cooling device and into the supply air duct.

According to another aspect, the air circulation means can be a fan.

According to another aspect, there can be provided a ledge extending to the product display area at the base of each of the second opposing set of the side walls, and the air return vent can be located on the ledge.

According to another aspect, the floor of the product display area is removable.

According to another aspect, the cooling device can be an evaporator.

According to another aspect, there can be provided a lower area of the bin located below the cooling area, the lower area housing additional cooling equipment.

According to another aspect, an underside of the lower area of the bin can comprise an air intake vent.

According to another aspect, the air intake vent can comprise a filter.

According to another aspect, the lower area can further comprise diverting walls to direct air from the intake vent toward the additional cooling equipment.

According to another aspect, the underside of the lower area of the bin can comprise an air exhaust vent.

According to another aspect, there can be provided an insulating layer that separates the cooling area, the supply air duct, and/or the return air duct from a lower area of the bin.

BRIEF DESCRIPTION OF THE DRAWINGS

In the drawings:

FIG. 12 is a table of the average recorded temperatures over a 24 hour time period.

DETAILED DESCRIPTION OF THE INVENTION

Figure 1:
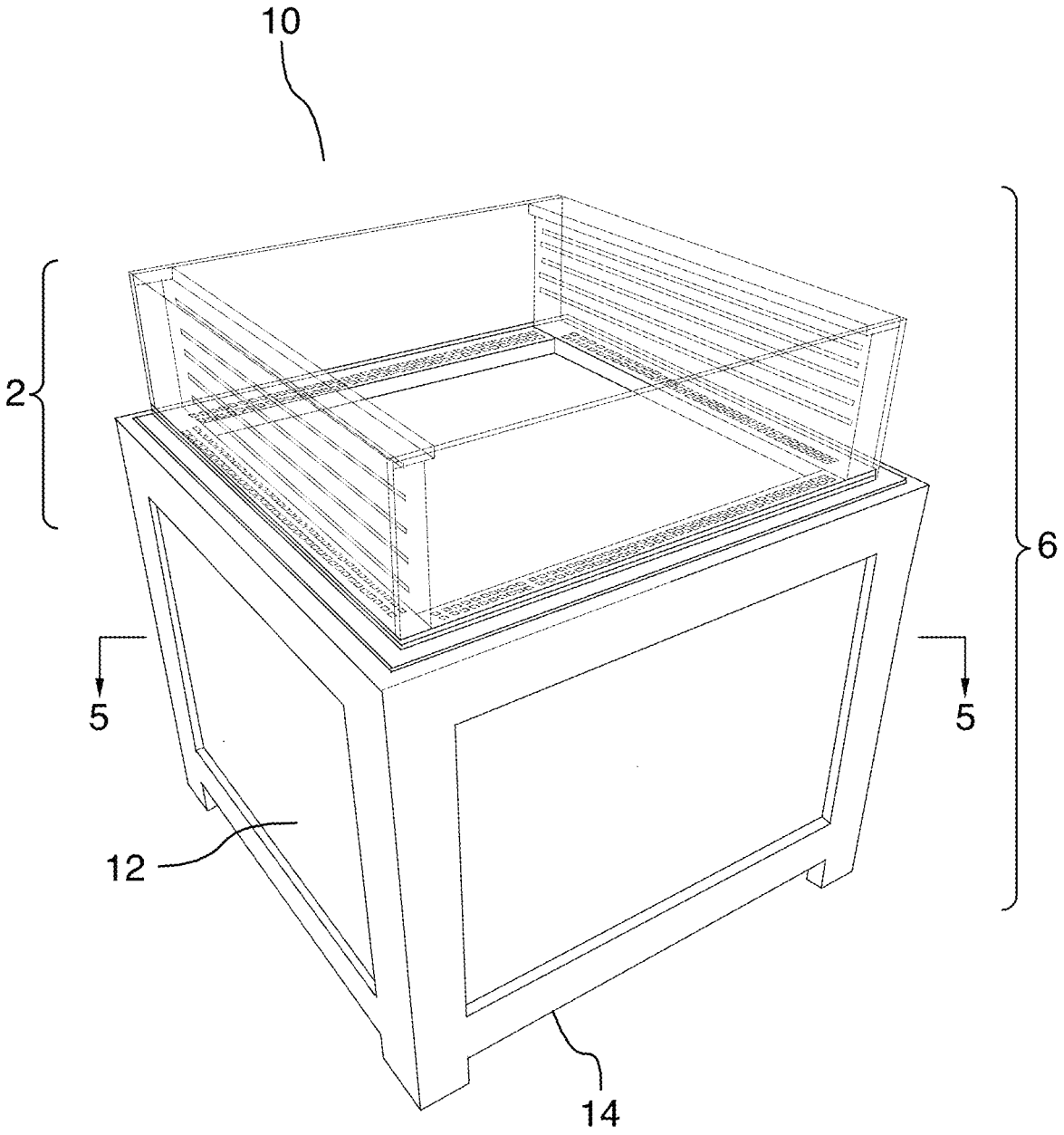
FIG. 1 is a perspective view of a refrigeration bin according to an embodiment of the invention.

A refrigeration bin 10 according to an embodiment of the present invention is shown in FIG. 1. The bin 10 includes four sides 12 and a bottom 14. The bottom 14 is elevated from the ground by feet as shown in FIG. 1.

A product receiving area 18' is defined by interior side walls 20*a*-20*d*, a floor 22 and an access opening. The floor 22 of the product receiving area 18' includes a removable tray 23 positioned on a projection 26. The removable nature of tray 23 provides easy access to components located below the product receiving area 18', discussed further below.

Interior side walls 20*a,b* have associated therewith a plurality of air supply vents 28. The air supply vents 28 span the width of the interior side walls 20*a,b* and consist of apertures that are orientated towards a product display area 18. Notably, side walls 20*a,b* are constructed out of transparent acrylic to maximize visibility of the product display area 18.

Air return vents 32 are located at the base of, and extend alongside, side walls 20*c,d* on ledges 34 that extend to the product display area 18 and define part of the floor 22. The ledges 34 in this embodiment are generally coplanar with and slightly raised relative to the tray 23.

The air return vents 32 are in air flow communication with a cooling area 38 disposed under the floor 22 of the product receiving area 18', and are formed by lower interior side walls 46 and a lower floor 48. The cooling area 38 includes air circulation means, such as a fan 40, which creates negative pressure in the cooling area 38 to draw air through the air return vents 32 into the cooling area 38. A cooling device 42, in this embodiment, an evaporator 42, is also located in the cooling area 38. The fan 40 is situated and positioned such that it draws the return air into the cooling area 38 and directs the return air over the cooling device 42. For example, as shown in FIGS. 3 and 4, the fan 40 is substantially located over top of the cooling device 42, and is able to direct the return air downward over the cooling device 42.

Air supply ducts 44 are in air flow communication with the product receiving area 18' through the air supply vents 28. The air supply ducts 44 are located exteriorly of the interior side walls 20*a,b* and transport cooled air from the cooling area to the product receiving area 18'. In this embodiment, all of the interior side walls 20*a-d* are transparent acrylic and transparent walls define, in combination side walls 20 *a,b*, substantially all of the ducts 44 that are disposed above the floor 22.

Figure 3:
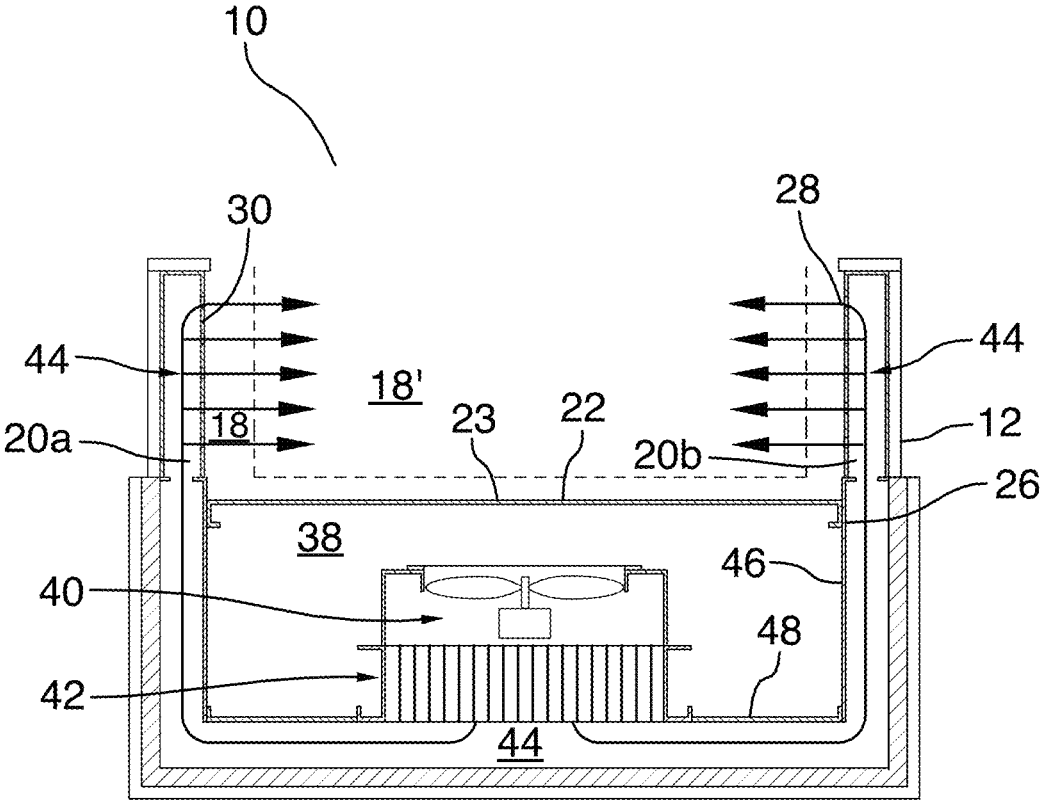
FIG. 3 is a view along 3-3 of FIG. 2.
Figure 4:
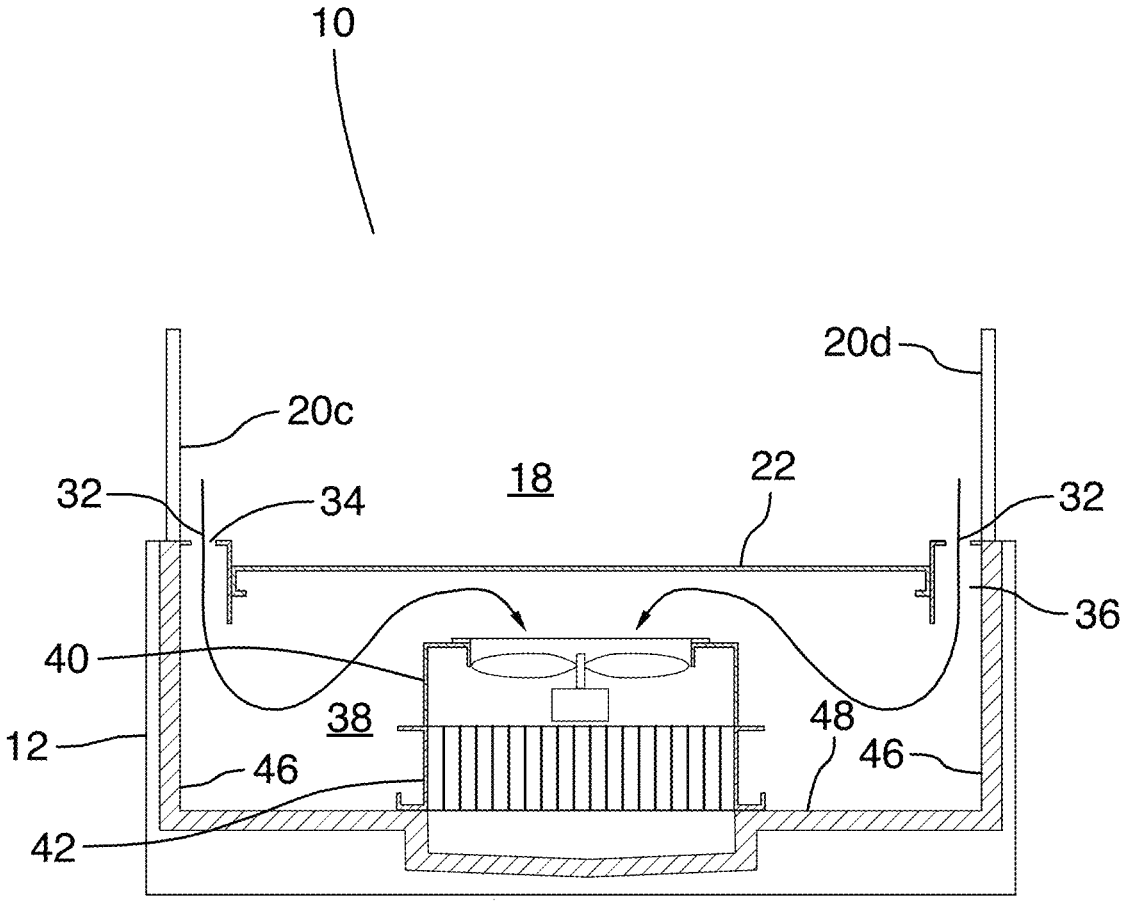
FIG. 4 is a view along 4-4 of FIG. 2.
Figure 5:
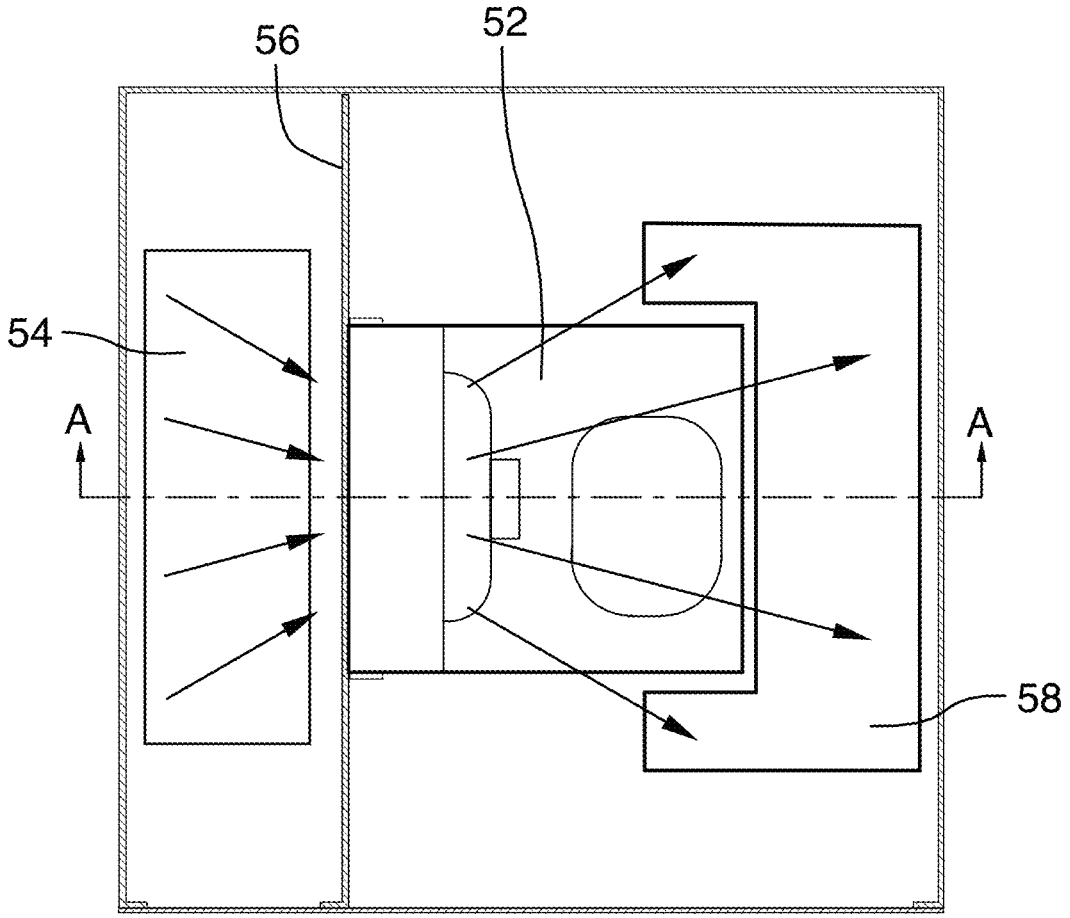
FIG. 5 is a view along 5-5 of FIG. 1.

In this embodiment, as shown in FIG. 3, the cooling device 42 is located at the interface between the cooling area 38 and the air supply duct 44. With the fan situated over the cooling device 42, air that has passed over or through the cooling device 42 will enter the air supply duct 44.

The air supply duct 44 branches off in opposing directions to provide cooled air up the interior side walls 20*a*, 20*b* to the air supply vents 28 and into the product receiving area 18'.

An insulating layer separates the cooling area 38 and the air supply duct 44 from a lower area 50 of the bin 10.

Figure 2:
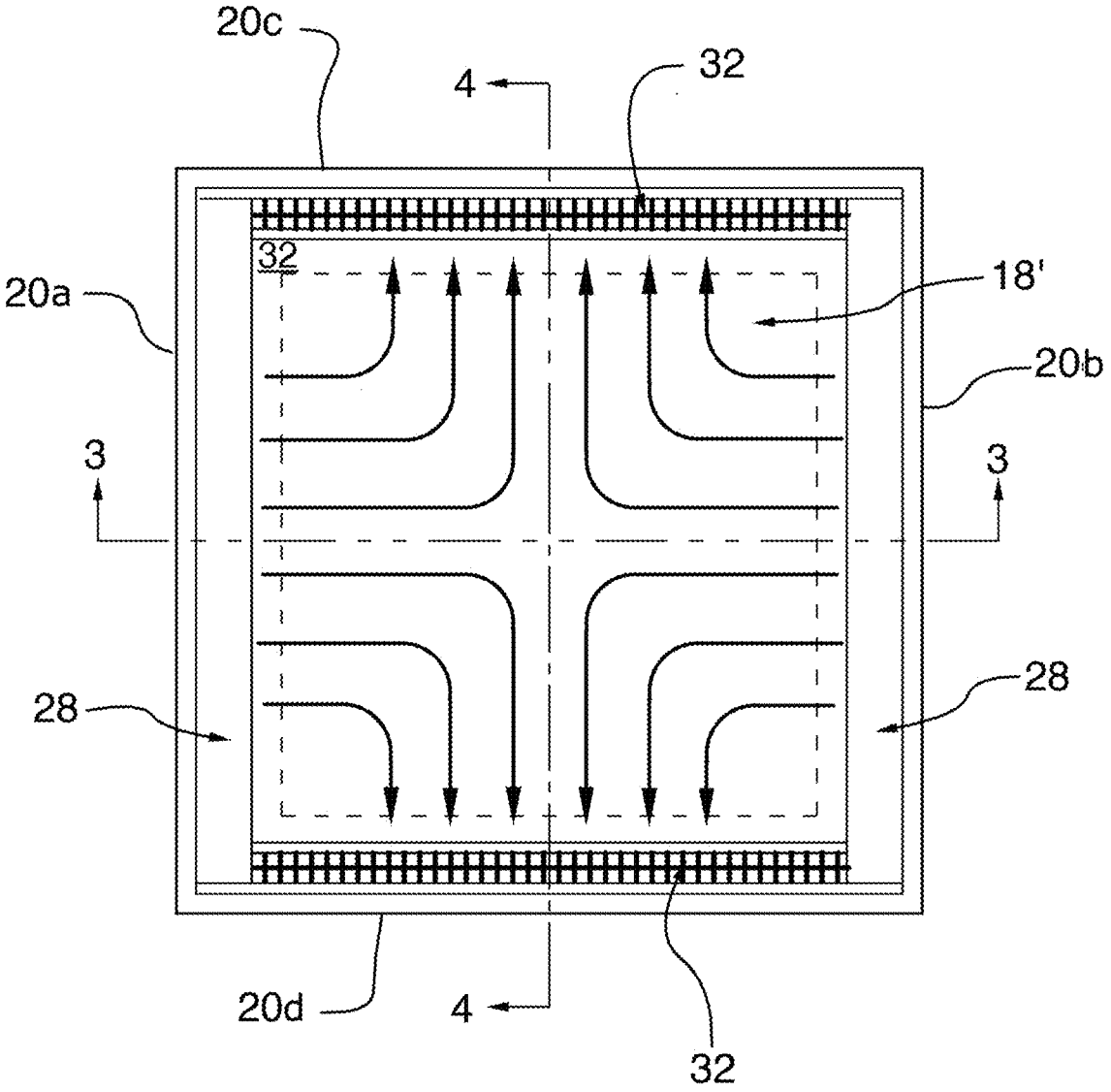
FIG. 2 is a top plan view of bracketed portion 2 of FIG. 1.

Including the air supply vents 28 on interior side walls 20*a*, 20*b* and the air return vents 32 at the bases of opposing interior side walls 20*c*, 20*d* creates a unique airflow as shown in FIGS. 2-4 which is relatively streamlined and efficient, and results in a relatively short distance over which the air is required to travel before it is re-cooled.

Figure 6:
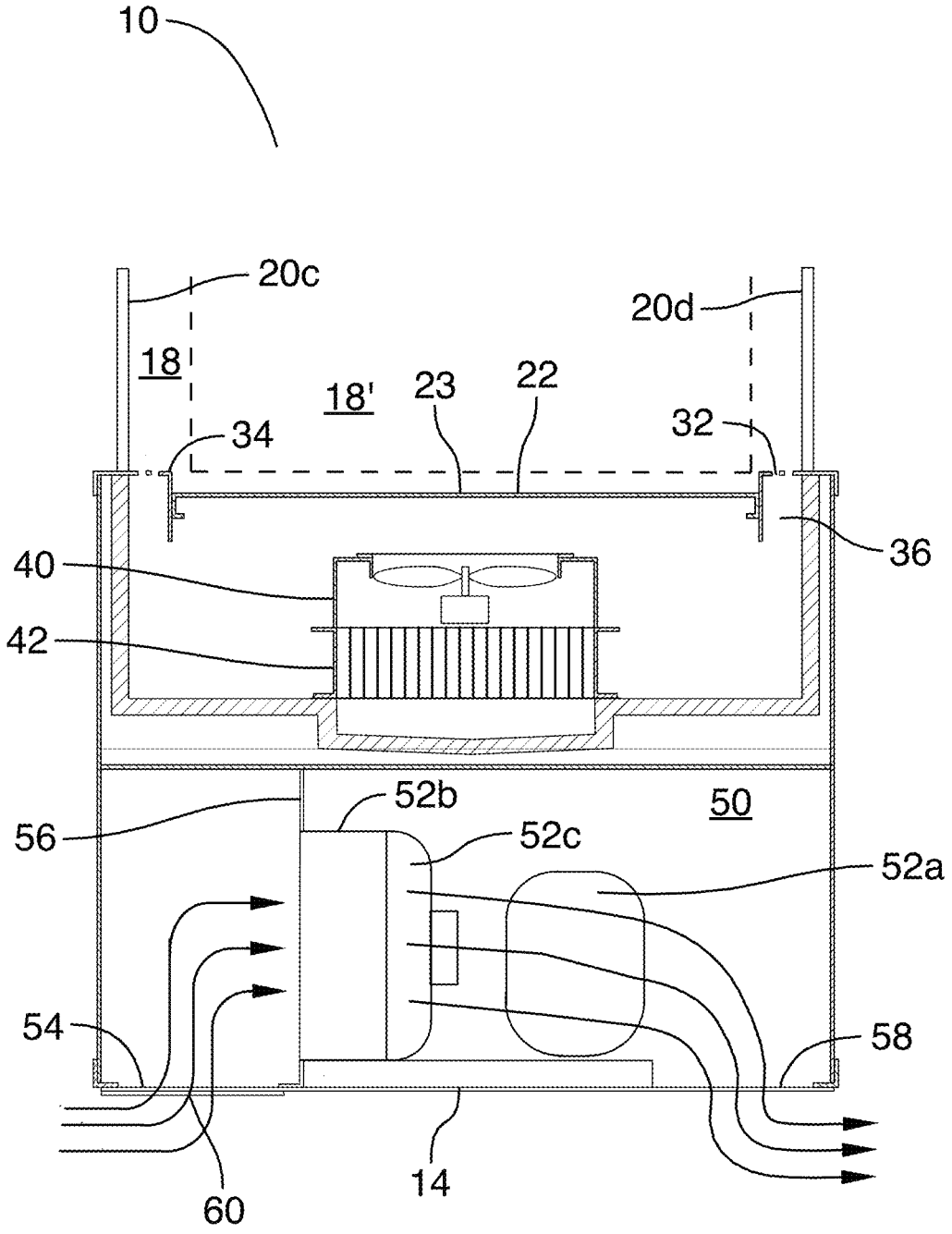
FIG. 6 is a view, similar to FIG. 3, but of bracketed portion 6 of FIG. 1.

Additional equipment required to operate the cooling device 42, such as a compressor 52*a*, condenser 52*b*, and exhaust fan 52*c*, is housed in the lower area 50 (See FIG. 6). Operation of such equipment requires air flow to cool the condenser 52*b*. The bin 10 includes at least one air intake vent 54 that, assisted by the exhaust fan 52*c*, draws ambient air into the lower area 50 of the bin 10. Preferably, the air intake vent 54 is located on the underside or bottom 14 of the bin 10. Once inside, diverting walls 56 direct the air toward and through condenser 52*b*. After passing through the condenser 52*b*, the temperature of the ambient air has been raised, and this exhaust air is expelled by from the bin 10 by the exhaust fan 52*c* through an exhaust vent 58 located on the underside of the bin 10.

Since the air intake vent 54 is on the underside of the bin 10, there is the possibility of drawing in dirt and debris with the ambient air which could adversely affect the cooling equipment. Accordingly, the air intake vent 54 is fitted with a filter 60.

Since the air intake and exhaust vents 54, 58 are on the underside of the bin 10 in this embodiment, the external venting covers, filter, and grills will not readily be visible. This arrangement is also advantageous in terms of the noise signature of the bin 10, as noise from the exhaust and cooling equipment will be directed at the underlying floor, rather than laterally out into the store environment.

Figure 7:
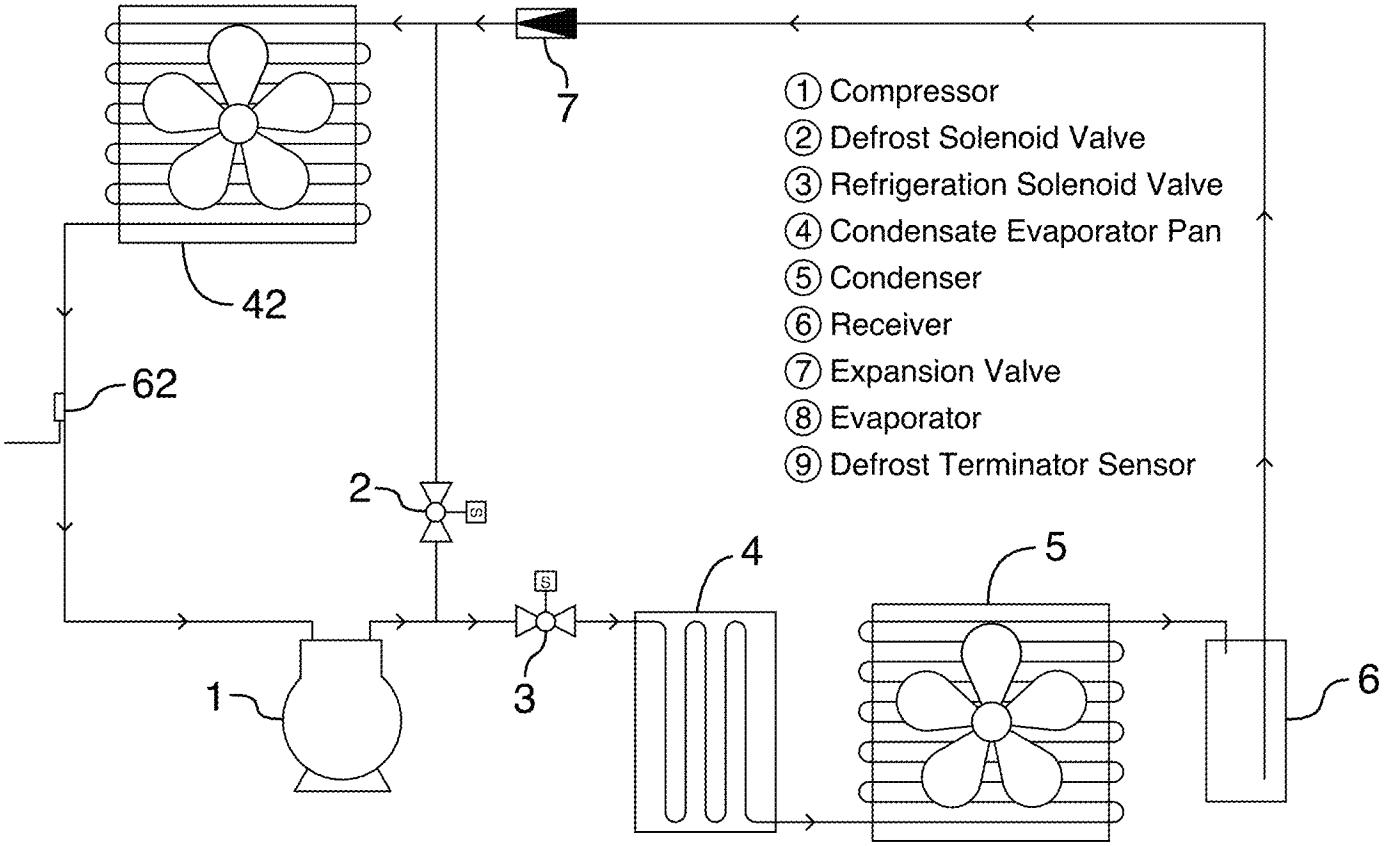
FIG. 7 is a schematic view of an embodiment of the present invention in a refrigeration cycle.
Figure 8:
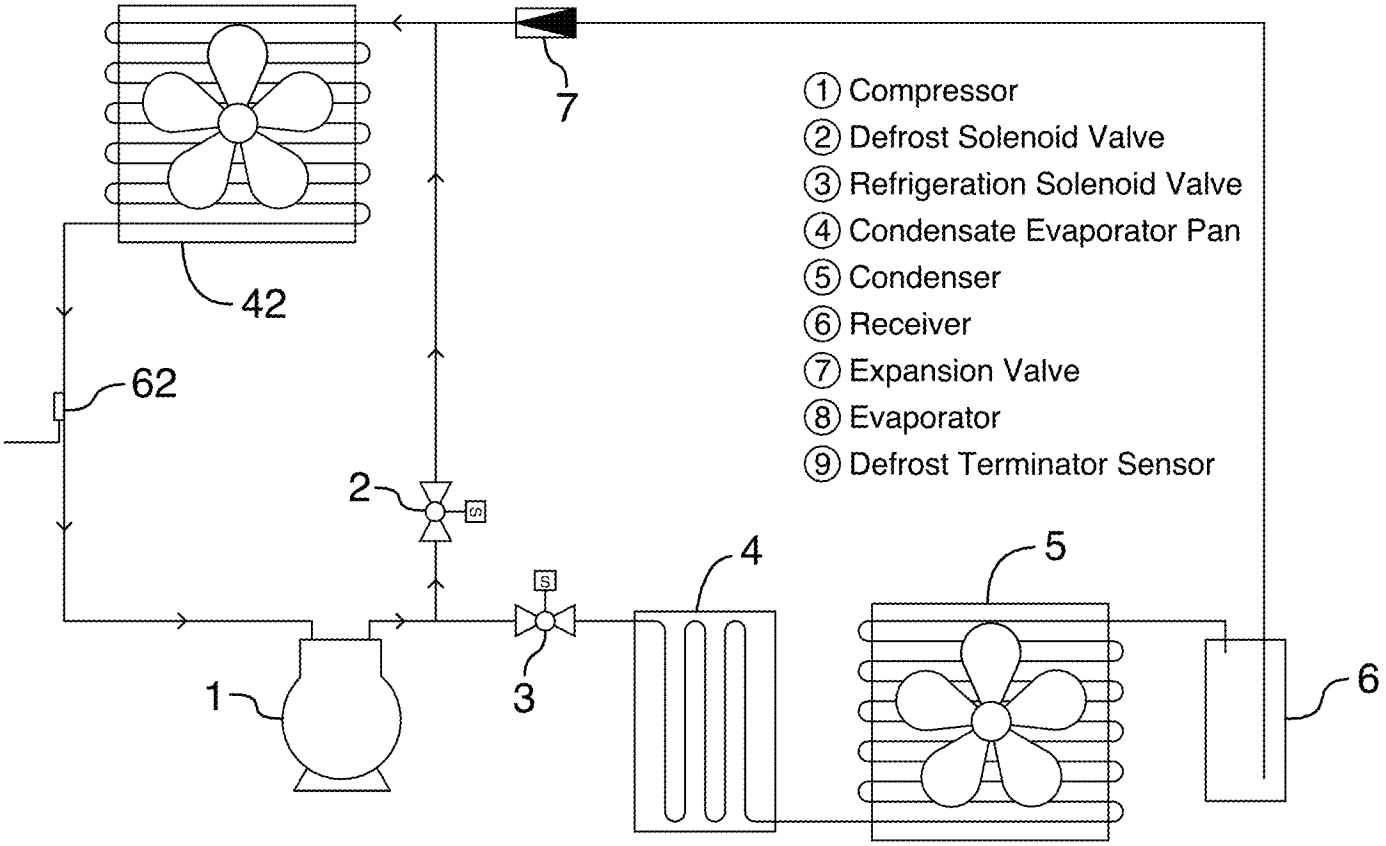
FIG. 8 is a schematic view of an embodiment of the present invention in a defrost cycle.

During use, frost may collect on the cooling device 42 or evaporator. The ice can then act as a de facto layer of insulation, which reduces heat transfer and impedes air flow. In this embodiment, the bin 10 uses a hot-gas defrost system to defrost the cooling device 42. A refrigeration system schematic according to this embodiment is shown in FIG. 7. The path the refrigerant takes is shown with arrows, in which it travels from the cooling device/evaporator 42 to the compressor, condenser, and expansion valve. The system includes a number of valves along the pathway that can direct flow of the refrigerant. During a refrigeration mode, a refrigeration valve is open and a defrost valve is closed, allowing the refrigerant to complete its typical cycle. A hot-gas defrost system, which would be familiar to one of skill in the art, uses heat already being generated by other members of the cooling system, such as the refrigerant compressor, to defrost the evaporator. See for example FIG. 8 which shows the same system during a defrost mode, in which the refrigeration valve is closed and the defrost valve is open. The refrigerant, heated up by the compressor, is diverted directly to the evaporator to melt accumulated frost and/or ice as shown by the arrows.

In this embodiment, the bin 10 enters a defrost mode based on certain time intervals, however, the defrost mode is terminated when a sensor 62 detects that all or most of the ice is removed from the evaporator. A sensor 62 is utilized so that defrost mode is only initiated when a certain threshold of ice develops on the evaporator 42. The sensor 62 is able to directly or indirectly operate the refrigeration and defrost valves, thereby controlling the path of the refrigerant in the system, and alternating between a refrigeration mode and a defrost mode. This minimizes the duration of the defrost mode and improves bin 10 efficiency, as the temperature increase associated with a typical defrost mode is minimal, which is also better for the product in the product display area 18. Holding these defrosts at frequent yet shortened intervals keeps the bin running at relatively high efficiency, and the small amounts of condensate water generated from the defrost can be removed using excess compressor heat, which obviates or minimizes the need for an evaporator pan, with commensurate impacts on overall energy consumption of the bin.

The bin preferably has all venting located on the underside of the showcase, greatly improving appearance. This results in a showcase with that is relatively attractive and customizable.

Exemplary specifications for this embodiment are an airflow of about between 200 to 225 cubic feet per minute through the evaporator, a rating of the cooling device of about 2800 BTU @ 15 F, a suction temperature of about 15-20 F during a typical cycle, and a condensing temperature of about 100-110 F during typical operation. The return air duct has an open air ration of about 0.423 and the supply air duct has an open air ration of about 0.062. The product display area 18 is about 26 inches by 26 inches, and has a height of about 9 inches.

Figure 9:
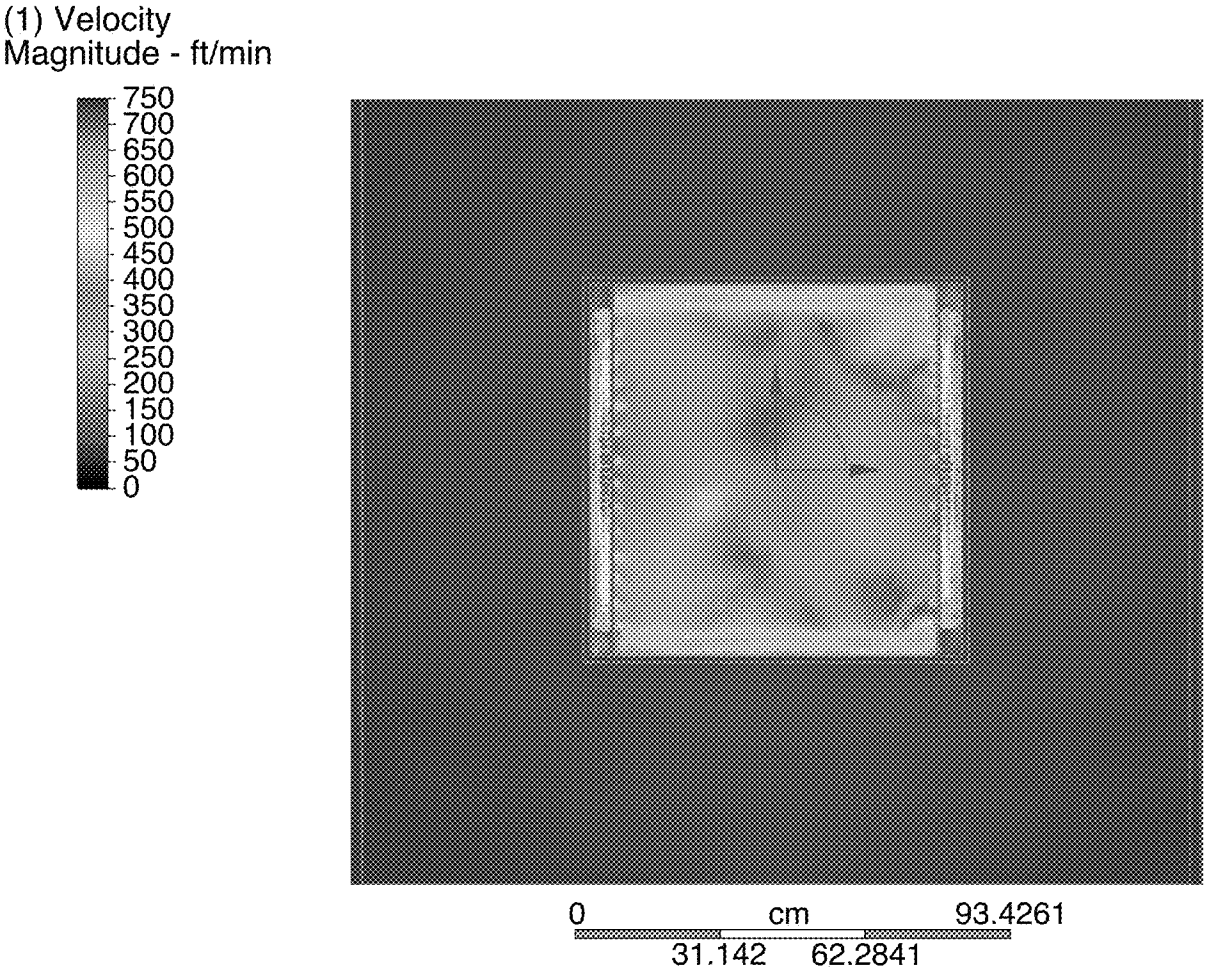
FIG. 9 is a top plan view similar to FIG. 2 showing airflow.
Figure 10:
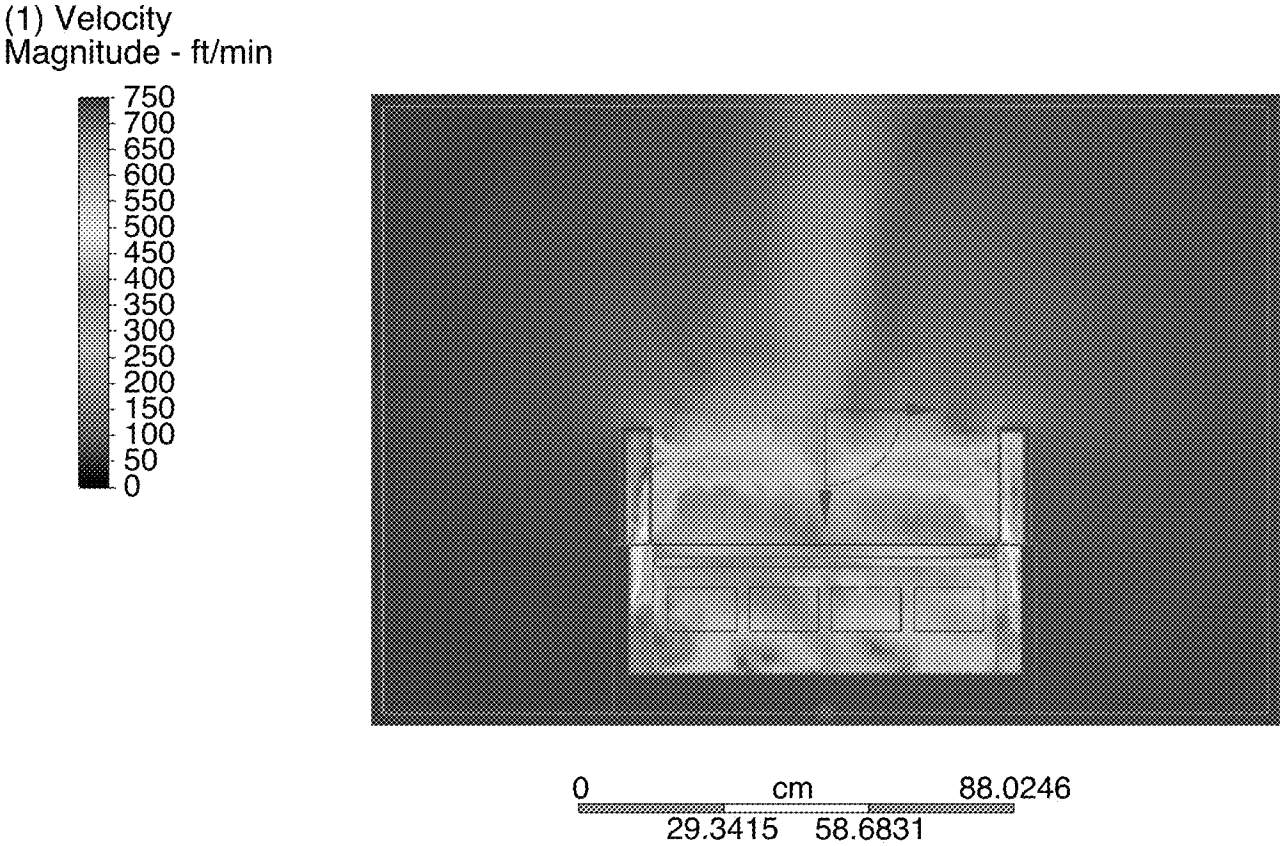
FIG. 10 is a view similar to FIG. 3 showing airflow.
Figure 11:
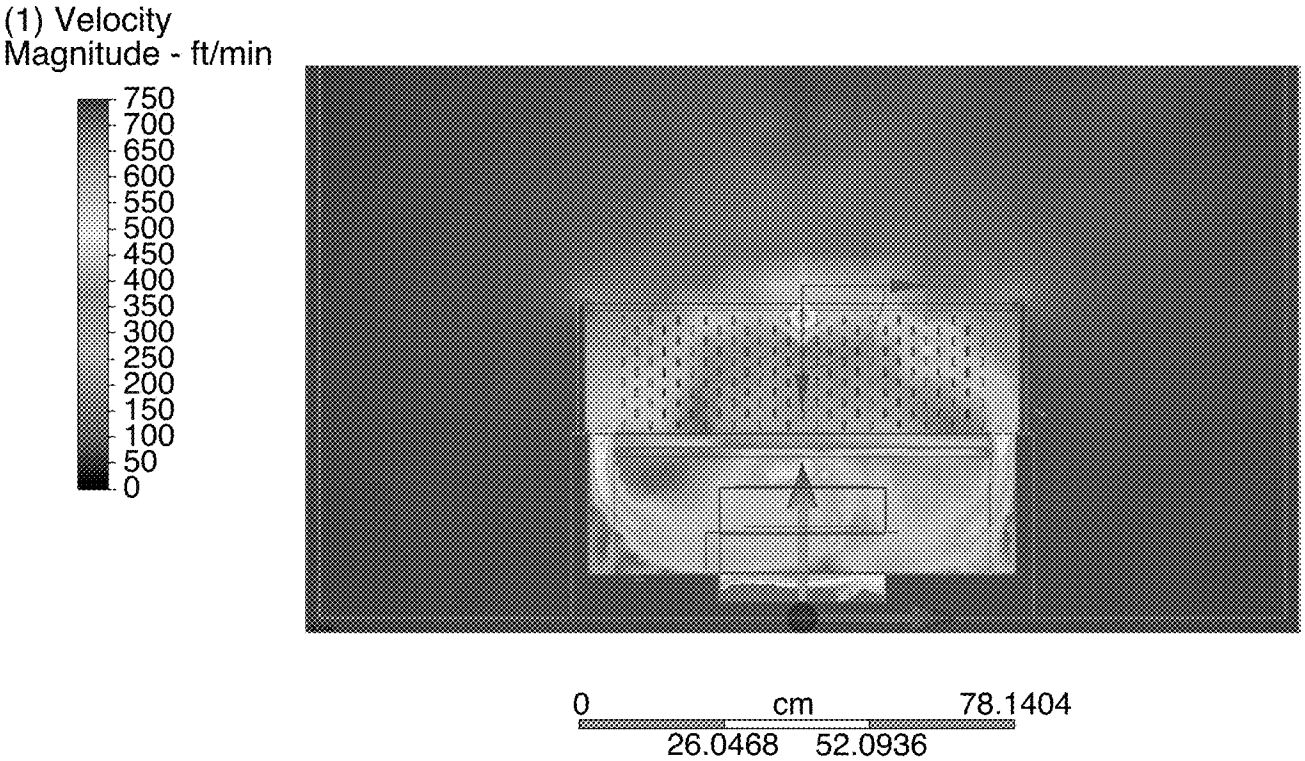
FIG. 11 is a view similar to FIG. 4 showing airflow.

Air flow within the refrigeration bin was tested. FIG. 9 shows an overhead view of the air circulating through the product display area 18. FIG. 10 shows the cooled air being blown through the cooling device 42, up through the air supply ducts 44, and out the air supply vents 28 into the product display area 18. FIG. 11 shows the air in the product display area 18 being drawn into the air return vents 32, down the air return ducts 36 into the cooling area 38, and then passed through the cooling device 42 into the air supply vents 28.

Testing of the bin 10 was carried out according to ASHRAE standard 72, which outlines the industry standard for such a type of test.

Briefly, product simulators of approximately 4" L×4" H×2½" T were filled with sponge material and saturated with a 50% solution of p-glycol and distilled water as per ASHRAE 72.6.2.1. These containers were positioned in a 6×6 grid pattern 3 containers high to fill the display area of the product display area as per ASHRAE 72.6.2.5. Thermocouples were placed in 10 product simulators as per ASHRAE 72.6.2.1, and located in the 4 corners of the showcase as per ASHRAE 72.6.2.3 and 72.6.2.4. These locations were the 4 corners of the showcase in the top and bottom of the stacks of product simulators. Additional product simulators were placed in the top and bottom of the central stack of product simulators since it was determined during testing to be the warmest point in the showcase as per ASHRAE 72.6.2.1.

Test Procedure

The refrigerated bin was allowed operate until a steady-state condition was achieved (the product simulator temperatures stabilized).

Temperature recordings then began to be taken at 5 minute intervals, as per standard NSF/ANSI 7.9.14.2., dry bulb and wet bulb readings at location Ta and dry bulb readings at Tb as directed by ASHRAE 72.4.1.1 and 72.4.1.2 were also recorded; as well as light intensity (lux) as per ASHRAE 72.4.1.5, air currents as per ASHRAE 72.4.1.4, and radiant heat as per ASHRAE 72.4.1.6.

The recordings were taken for a period of 24 hours as per NSF/ANSI 7.9.14.2 and upon evaluation met the requirements of NSF/ANSI 7.9.14.3 (not to exceed 5° C. average temperature, at no point above 6° C.).

The average recorded temperatures over the 24 hour period are provided in a Table in FIG. 12.

Food safety standards require that the temperature at various points inside the product display area 18 must remain below 5° C. over the duration of the test. Table 1 illustrates that all areas of the display area 18 were well under 5° C. as measured over a 24 hour period.

When in use, product can be stacked on the floor 22 up to the top of the product display area 18. The stacked product can be adjacent the supply air vents 28 without adversely affecting operation, although it is preferred that the return air vents 32 be kept free of product.

Variants

Although a specific embodiment is herein shown and described, variations are possible.

For example, although feet are shown in FIG. 1, it will be appreciated that casters or the like could also be used.

Further, whereas a removable tray is shown, to provide access to the components below the bin, this is not necessary and a door or the like in the lower portion of the bin could equally be used.

Although transparent material is specified as the material of construction of the interior side walls, this is not necessary.

Although the sensor 62 is shown is being located between the evaporator and the compressor, other locations can also be used provided the sensor is capable of performing its desired function.

Further, whereas the bin is specified to have four side walls, arranged in orthogonal relation, it is contemplated that this is not strictly necessary and bins with, for example, rounded corners could be used.

Accordingly, the invention should be understood to be limited only by the accompanying claims, purposively construed.

The invention claimed is:

1. A refrigeration bin comprising:

a product receiving area;

a product display area contained within the product receiving area;

a plurality of air supply vents, each disposed exteriorly of the product display area, communicating with the product receiving area and directed towards the product display area;

a plurality of air return vents, each disposed exteriorly of the product display area, beneath the air supply vents and communicating with the product receiving area; and an air cooling device for cooling air drawn from the air return vents and delivering same to the air supply vents;

wherein:

the product receiving area is bounded at a bottom by a floor, on sides by a wall structure and on a top by an opening;

the product display area is bounded at the bottom by the floor;

the plurality of air return vents are defined in the floor between the product display area and the product receiving area;

the wall structure has defined therein the plurality of air supply vents;

the wall structure comprises a first pair of walls and a second pair of walls, the first pair of walls being disposed in parallel spaced relation to one another and the second pair of walls being disposed in spaced parallel relation to one another and arranged in perpendicular relation with respect to the first pair of walls to define in combination therewith a rectangular enclosure;

the air supply vents are planar and span substantially an entirety of the first pair of walls;

the air return vents are linear and substantially span the lengths of the second pair of walls and are disposed at the bases thereof; and at least substantially all of the air supply vents are defined in the first pair of walls and at least substantially all of the air return vents are disposed at the bases of the second pair of walls.

2. A refrigeration bin according to claim 1, wherein the wall structure is transparent.

3. A refrigeration bin according to claim 2, further comprising a cooling area located below the floor of the product receiving area.

4. A refrigeration bin according to claim 3, wherein the air cooling device is in the cooling area.

5. A refrigeration bin according to claim 4, wherein each of the first pair of walls has a hollow interior and the bin further comprises an air circulation means in the cooling area, positioned to direct air to the air cooling device and into a supply air duct defined at least in part by the hollow interiors.

6. A refrigeration bin according to claim 5, wherein the air circulation means is a fan.

7. A refrigeration bin according to claim 1, wherein the floor of the product receiving area is removable.

8. A refrigeration bin according to claim 1, wherein the air cooling device is an evaporator.

* * * * *